US008431844B2

(12) United States Patent
Chen

(10) Patent No.: US 8,431,844 B2
(45) Date of Patent: Apr. 30, 2013

(54) SWITCH DEVICE FOR IMPLEMENTING POWER-ON PROCESS AND RELATED METHOD AND PORTABLE COMPUTER SYSTEM

(75) Inventor: Yung-Feng Chen, Taipei Hsien (TW)

(73) Assignee: Wistron Corporation, Xizhi Dist., New Taipei (TW)

( * ) Notice: Subject to any disclaimer, the term of this patent is extended or adjusted under 35 U.S.C. 154(b) by 960 days.

(21) Appl. No.: 12/233,612

(22) Filed: Sep. 19, 2008

(65) Prior Publication Data

US 2009/0301847 A1 Dec. 10, 2009

(30) Foreign Application Priority Data

Jun. 9, 2008 (TW) ..... 97121393 A

(51) Int. Cl.
*H01H 27/00* (2006.01)

(52) U.S. Cl.
USPC ..... 200/43.04; 20/43.08

(58) Field of Classification Search ..... 200/43.04, 200/43.05, 43.07, 43.08
See application file for complete search history.

(56) References Cited

U.S. PATENT DOCUMENTS 2,105,304 A * 1/1938 Wagner ..... 200/43.05
5,003,801 A * 4/1991 Stinar et al. ..... 70/278.3
7,489,974 B2 * 2/2009 Numano ..... 700/22

FOREIGN PATENT DOCUMENTS

CN 2502312 Y 7/2002

* cited by examiner

*Primary Examiner* — Renee Luebke
*Assistant Examiner* — Lheiren Mae Caroc
(74) *Attorney, Agent, or Firm* — Winston Hsu; Scott Margo

(57) ABSTRACT

A switch device for implementing a power-on process for a portable electronic device includes a switch having a protrusion, a switch socket installed in the portable electronic device including a slot utilized for embedding the switch and a conducting portion for outputting a trigger signal while the protrusion is electrically connected to the conducting portion, and a trigger identification unit for starting the portable electronic device according to the trigger signal.

9 Claims, 9 Drawing Sheets

SWITCH DEVICE FOR IMPLEMENTING POWER-ON PROCESS AND RELATED METHOD AND PORTABLE COMPUTER SYSTEM

BACKGROUND OF THE INVENTION

1. Field of the Invention

The present invention relates to a switch device for implementing a power-on process and related method and portable computer system, and more particularly, to a switch device, related method and portable computer system capable of implementing a power-on process without utilizing a power on key.

2. Description of the Prior Art

A portable electronic device has several advantages, including small size, light weight, and convenience for carrying due to its portability, and provides powerful computation abilities and document or multimedia processing functions anywhere and anytime, allowing a user to work in any location outside an office.

When a user wants to activate a portable electronic device, the user needs to press down a power-on key for activating a power-on process. Generally speaking, position or keypad design of the power-on key is usually indistinct from other keys. If the user wants to activate the portable electronic device in a dark environment, much attention may be required on the user's part to find the power-on key and press down the key. In addition, if the power-on key is damaged or faulty, the user may not be able to activate the portable electronic device, and it may cause inconvenience for the user.

SUMMARY OF THE INVENTION

It is therefore a primary objective of the claimed invention to provide a switch device for implementing a power-on process and related method and portable computer system.

The present invention discloses a switch device for implementing a power-on process for a portable electronic device, which comprises a switch having a protrusion, a switch socket installed in the portable electronic device comprising a slot and a conducting portion, wherein the slot is utilized for embedding the switch, and the conducting portion is utilized for outputting a trigger signal while the protrusion is electrically connected to the conducting portion, and a trigger identification unit powered by a direct current power source and coupled to the conducting portion of the switch socket for activating an activation routine of the portable electronic device according to the trigger signal.

The present invention further discloses a power-on process implementation method for a portable electronic device, which comprises coupling a switch of the portable electronic device with a switch socket of the portable electronic device in order to provide power to the portable electronic device, outputting a trigger signal while a protrusion of the switch is electrically connected to a conducting portion of the switch socket, and detecting whether the trigger signal is inputted by a trigger identification unit and activating an activation routine of the portable electronic device according to the trigger signal.

The present invention further discloses a portable computer system, which comprises a processing unit for executing functions of the portable computer system, a controller installed in the processing unit for controlling operations of the processing unit, and a switch device, which the switch device comprises a switch having a protrusion for providing power, and a switch socket installed in the portable computer system, which the switch socket comprises a slot for embedding the switch, and a conducting portion for outputting a trigger signal while the protrusion is electrically connected to the conducting portion, and a trigger identification unit coupled between the conducting portion and the controller, and powered by a direct current power source for activating an activation routine of the portable computer system according to the trigger signal.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
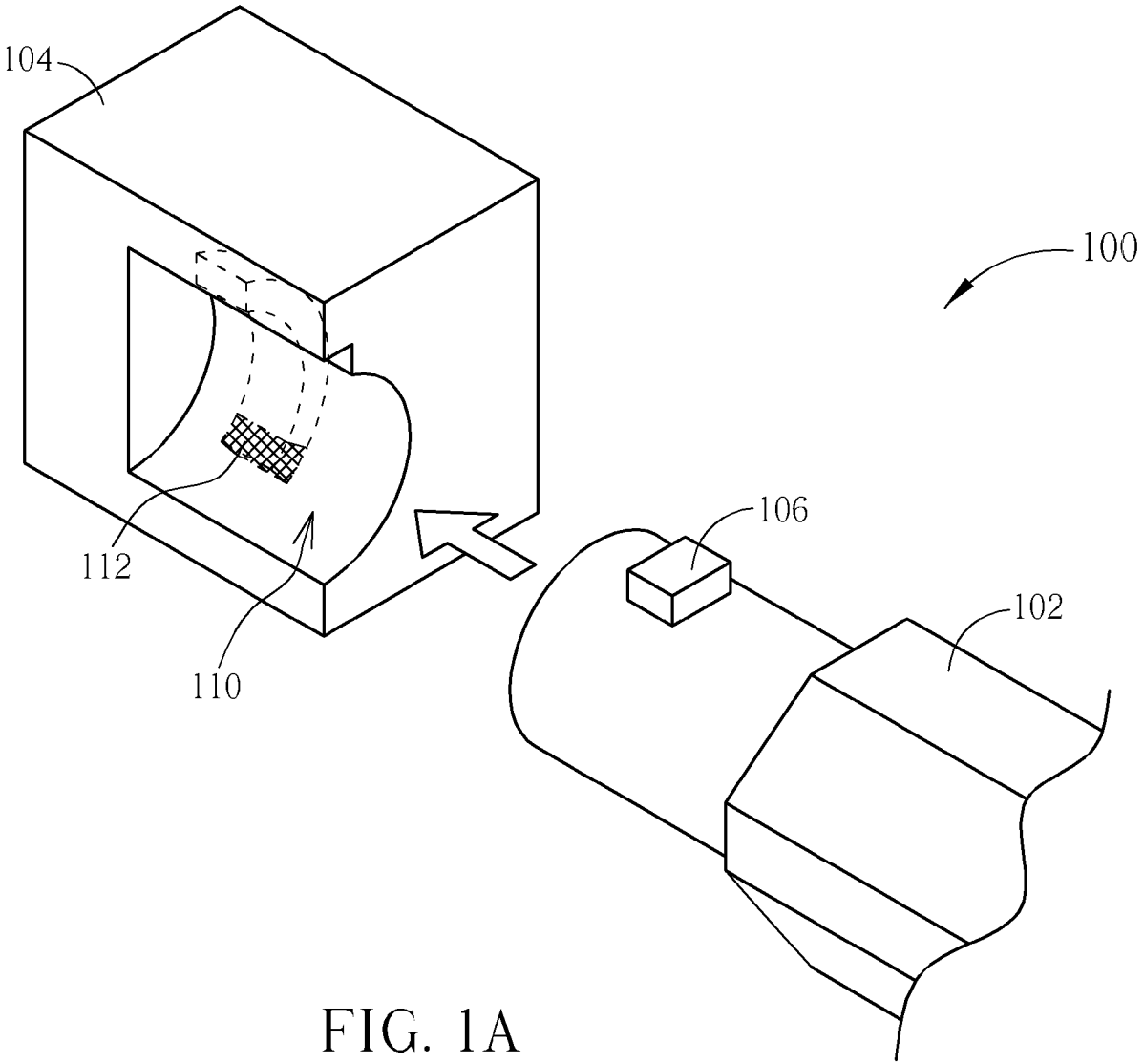
FIG. 1A is a sectional view of a switch device capable of implementing power-on process according to an embodiment of the present invention.
Figure 1B:
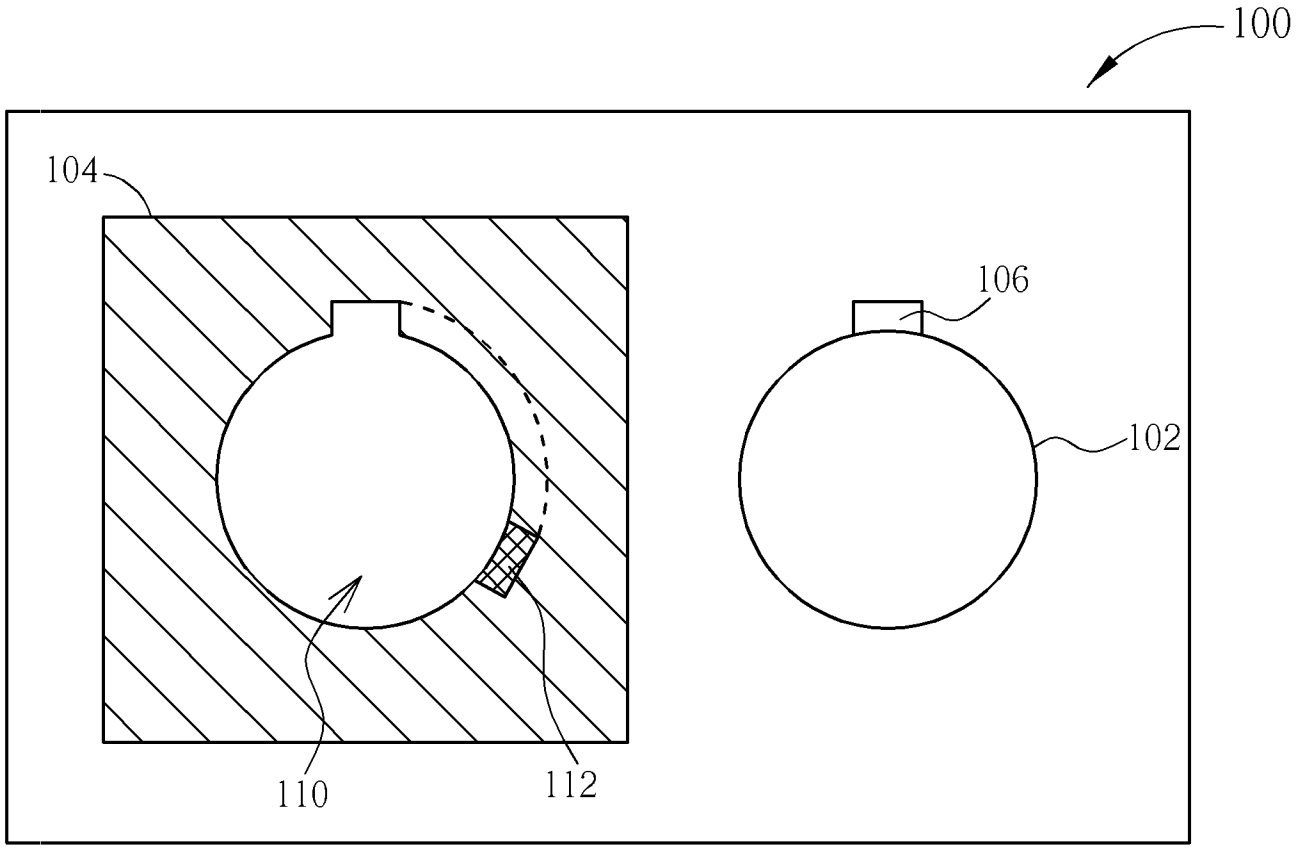
FIG. 1B is a front view of the switch device shown in FIG. 1A according to an embodiment of the present invention.

Please refer to FIG. 1A and FIG. 1B. FIG. 1A is a sectional view of a switch device 100 capable of implementing a power-on process according to an embodiment of the present invention. FIG. 1B is a front view of the switch device 100 shown in FIG. 1A according to an embodiment of the present invention. The switch device 100 includes a switch 102, a switch socket 104, and a trigger identification unit (not shown). The back end of the switch 102 is a power source (not shown), and the switch 102 includes a protrusion 106. The switch socket 104 is installed in a portable electronic device and includes a slot 110 and a conducting portion 112. The slot 110 is utilized for embedding the switch 102, and providing power to the portable electronic device after the switch 102 is rotated to a location.

Figure 2:
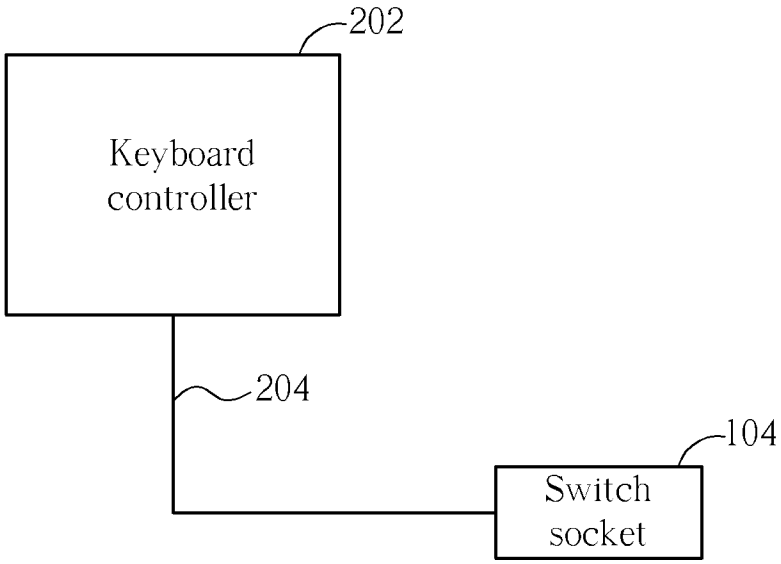
FIG. 2 is a schematic diagram of a trigger identification unit according to an embodiment of the present invention.

Furthermore, the protrusion 106 of the switch 102 is taken a certain displacement to couple with the conducting portion 112 so as to electrically connect to the conducting portion 112. While the protrusion 106 is electrically connected to the conducting portion 112, the conducting portion 112 outputs a trigger signal to a trigger identification unit. The trigger identification unit is capable of activating an activation routine of the portable electronic device according to the trigger signal. For example, please refer to FIG. 2. FIG. 2 is a schematic diagram of a trigger identification unit according to an embodiment of the present invention. When a system of the portable electronic device is operated in an APCI S5 state, the trigger identification unit, which may be a keyboard controller 202, is coupled to the conducting portion 112 of the switch socket 104 and powered by a direct current power source. A trigger signal outputted by the conducting portion 112 is transmitted to the keyboard controller 202 via a general purpose input/output unit 204 so as to activate an activation routine. In other words, a user is not only capable of providing power to the portable electronic device via the switch socket 104, but also activating an activation routine of the portable electronic device. When the user wants to activate the portable electronic device, the user can first couple the switch 102 with the slot 110, and then take the protrusion 106 a certain displacement to electrically couple with the conducting portion 112. After that, the conducting portion 112 outputs a trigger signal for the trigger identification unit so as to activate an activation routine of the portable electronic device. Thus, the present invention can implement a power-on process without a power-on key. The user just takes the protrusion 106 a certain displacement to electrically couple with the conducting portion 112, and the portable electronic device will be activated by a trigger signal. As a result, the power-on key can be reduced to save cost, and more importantly, to save required space.

Figure 3:
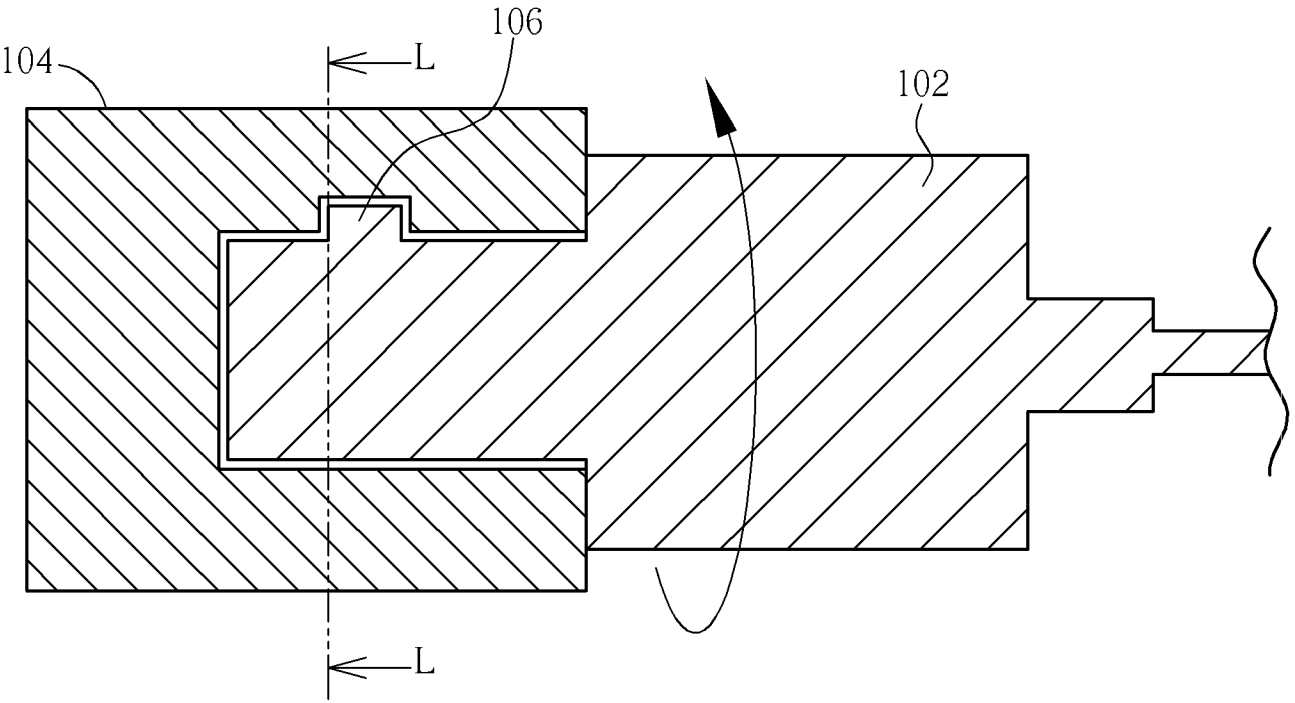
FIG. 3 is a schematic diagram of a slot being embedded with a switch shown in FIG. 1A according to an embodiment of the present invention.
Figure 4:
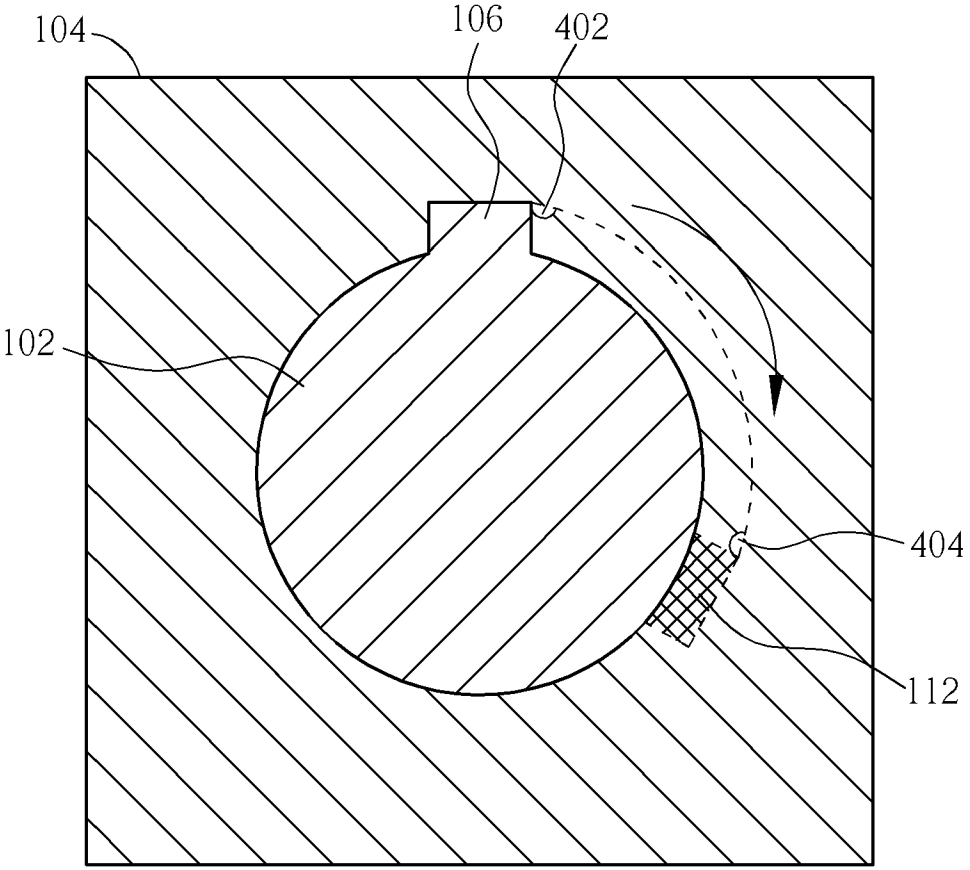
FIG. 4 is a cross sectional diagram along a line L shown in FIG. 3.

Therefore, if a user has a boot requirement, the user can just take the protrusion 106 a certain displacement to electrically couple with the conducting portion 112, and then the conducting portion 112 outputs a trigger signal, such that the trigger identification unit will activate an activation routine of the portable electronic device according to the trigger signal. Further description associated with operation of the switch device 100 is shown in FIG. 3 and FIG. 4. FIG. 3 is a schematic diagram of a slot embedded with the switch 102 shown in FIG. 2 according to an embodiment of the present invention. FIG. 3 is a schematic diagram of a slot embedded with the switch 102 shown in FIG. 1A according to an embodiment of the present invention. FIG. 4 is a cross sectional diagram along a line L shown in FIG. 3. As a user has a boot requirement, the switch 102 can be first embedded with the slot 110 and the protrusion 106 is rotated a certain angular displacement to electrically couple with the conducting portion 112, and then the conducting portion 112 outputs a trigger signal, such that the trigger identification unit activates an activation routine of the portable electronic device according to the trigger signal. In addition, to avoid an accidental contact activating the activation routine, the slot 110 further includes a first fixing unit 402 and a second fixing unit 404. The first fixing unit 402 is utilizing for fixing the switch after the slot 110 is embedded with the switch 102. The second fixing unit 404 is utilizing for fixing the switch 102, while the protrusion 106 is electrically connected to the conducting portion 112.

Figure 5:
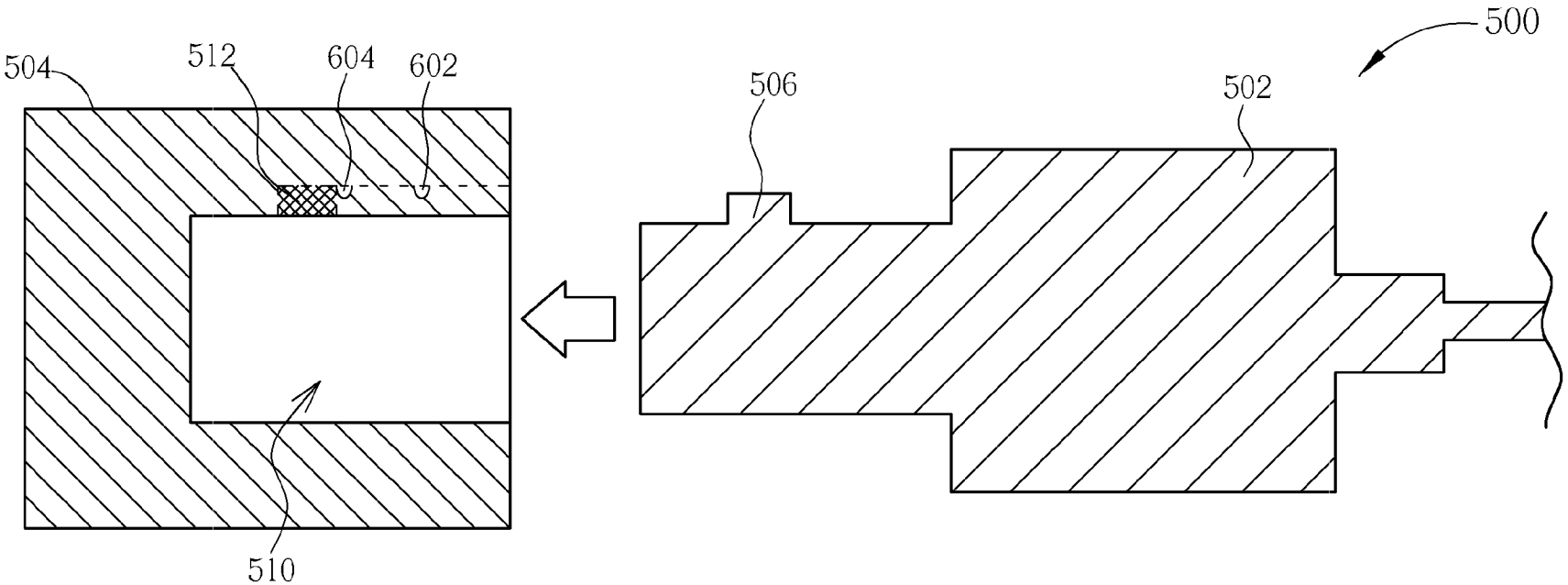
FIG. 5 is a schematic diagram of a switch device according to an embodiment of the present invention.
Figure 6:
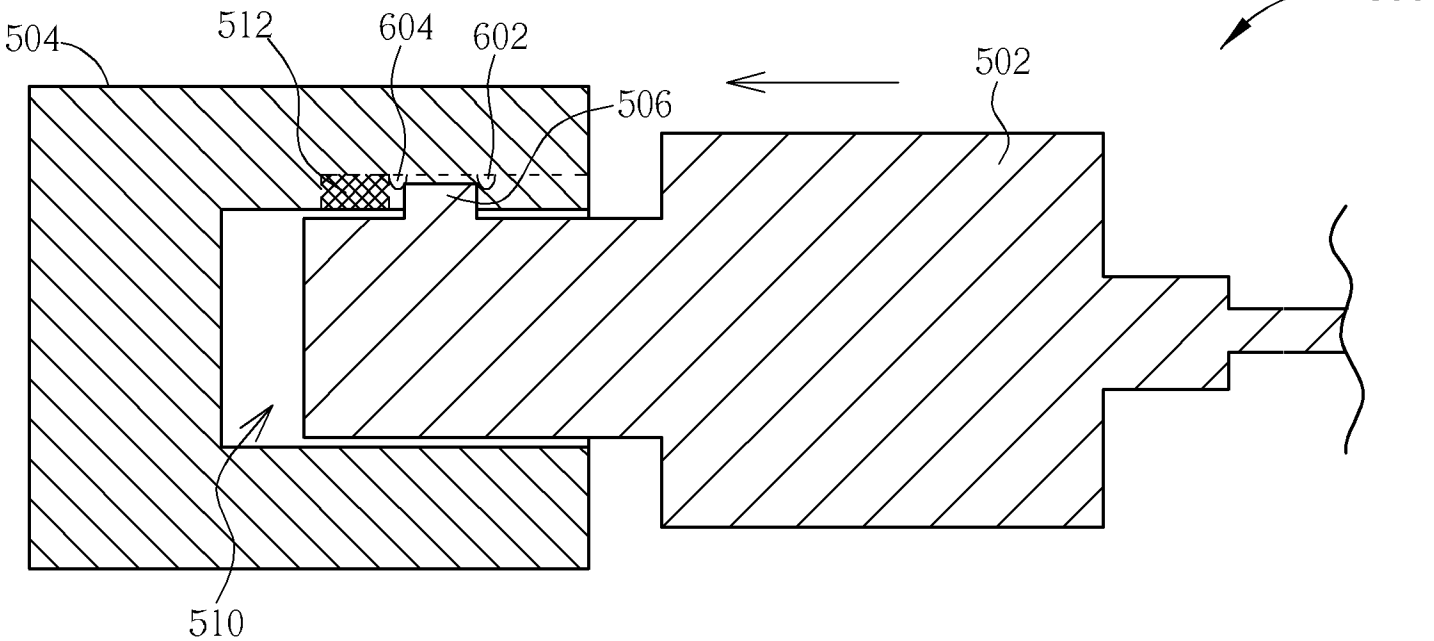
FIG. 6 is a schematic diagram of operation of the switch device according to an embodiment of the present invention.

The switch device 100 shown in FIG. 1A moves the protrusion 106 a certain range with rotation to electrically couple with the conducting portion 112 for activating an activation routine of the portable electronic device. Moreover, the switch device 100 can also move the protrusion 106 by pressing. For example, please refer to FIG. 5 and FIG. 6. FIG. 5 is a schematic diagram of a switch device 500 according to an embodiment of the present invention. FIG. 6 is a schematic diagram of operation of the switch device 500 according to an embodiment of the present invention. The switch device 500 includes a switch 502 and a switch socket 504. The switch 502 is utilizing for providing power, which includes a protrusion 506. The switch socket 504 is installed in a portable electronic device, which includes a slot 510 and a conducting portion 512, and a trigger identification unit.

The structure of the switch device 500 is similar to the switch 100 shown in FIG. 1A. But the switch 102 is coupled to the conducting portion 112 with rotation for the switch device 100, and the switch 502 is coupled to the conducting portion 512 with pressing for the switch device 500. As shown in FIG. 6, as a user has a boot requirement, the user can press down the protrusion 506 a certain displacement to electrically couple with the conducting portion 512, and then the conducting portion 512 outputs a trigger signal, such that the trigger identification unit activates an activation routine of the portable electronic device according to the trigger signal. In addition, to avoid activating the activation routine when accidental contact is made, the slot 510 further includes a first fixing unit 602 and a second fixing unit 604. The first fixing unit 602 is utilizing for fixing the switch after the slot 510 is embedded with the switch 502. The second fixing unit 604 is utilizing for fixing the switch 502 while the protrusion 506 is electrically connected to the conducting portion 512.

Please note that, FIG. 1A and FIG. 5 are schematic diagrams according to an exemplary embodiment of the present invention, and those skilled in the art can make alternations and modifications accordingly. Note that, the present invention can be applied with any approach, structure, position, or type, as the protrusion that can be taken a certain displacement to electrically couple with the conducting portion is available. In addition, the conducting portion is the expansion of the switch, so that any size, shape, or manufacture process of the conducting portion which can be electrically coupled with the conducting portion is suitable. And, there is also a corresponding switch socket for coupling to the switch.

From above, as the protrusion is electrically connected to the conducting portion, the conducting portion can output a trigger signal, so that any approach or circuit which can generate a trigger signal is suitable. The trigger identification unit is utilized for activating an activation routine of the portable electronic device according to the trigger signal. Moreover, any approach, or circuit which can activate an activation routine of the portable electronic device according to a trigger signal is suitable. For example, the trigger identification unit can be installed in a keyboard controller and transmit activation information via a general purpose input/output unit or an activation input/output unit of the keyboard controller.

Figure 7:
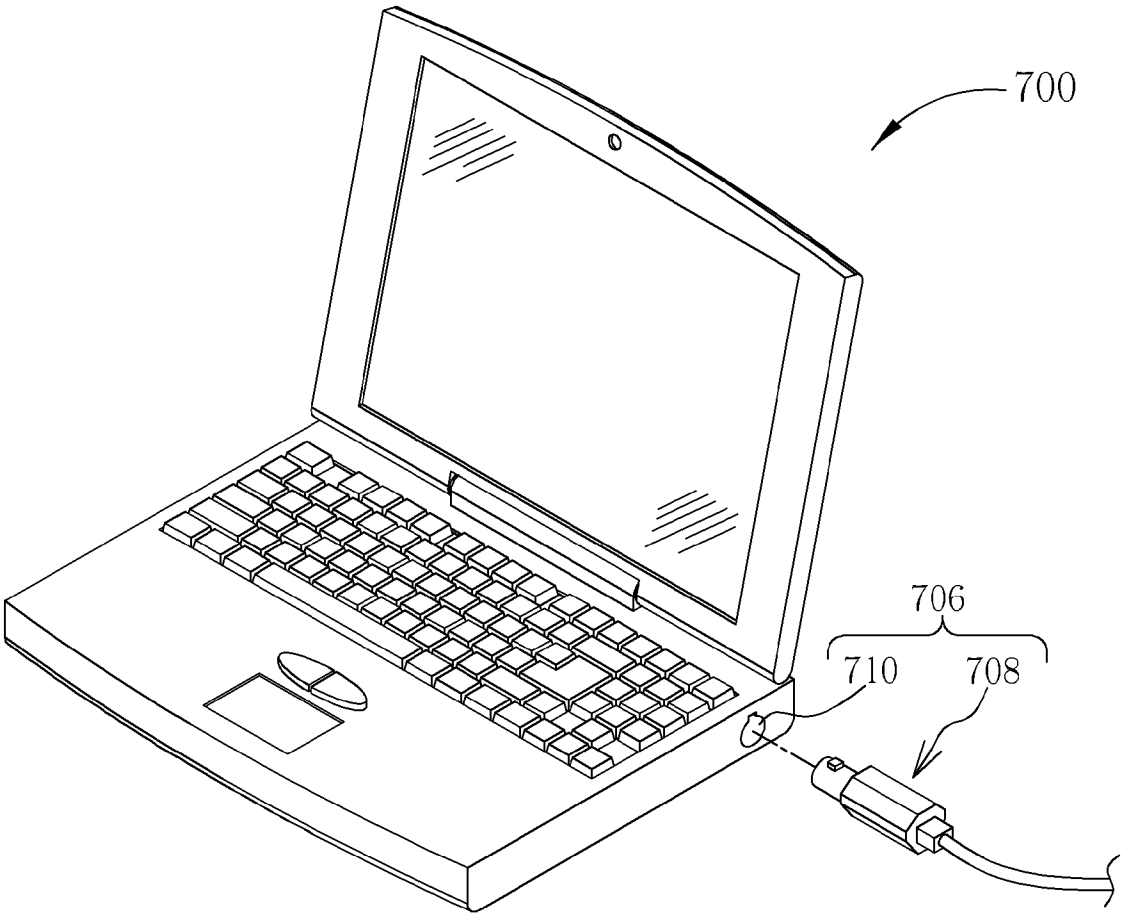
FIG. 7 is a schematic diagram of a portable computer system according to an embodiment of the present invention.

Besides, the portable electronic device can be any electronic device having portability and function of the power-on process, such as a portable computer system, PDA, GPS, smart phone, video game device, etc., and is not limited in the present invention. For example, please refer to FIG. 7. FIG. 7 is a schematic diagram of a portable computer system 700 according to an embodiment of the present invention. The portable computer system 700 includes a processing unit (not shown), a controller (not shown), and a switch device 706. The processing unit is utilized for executing functions of the portable computer system 700. The controller is installed in the processing unit for controlling operations of the processing unit. The switch device 706 is capable of the switch device 100 shown in FIG. 1 or the switch device 500 shown in FIG. 5. The switch device 706 includes a switch 708 and a switch socket 710. If a user has a boot requirement, the user just connects the switch to the switch socket 710 and takes a protrusion of the switch 708 a certain displacement to electrically couple with a conducting portion of the switch socket 710, and the portable computer system 700 will be activated. As a result, the power-on key can be reduced to save cost, and more importantly, to save required space.

Figure 8:
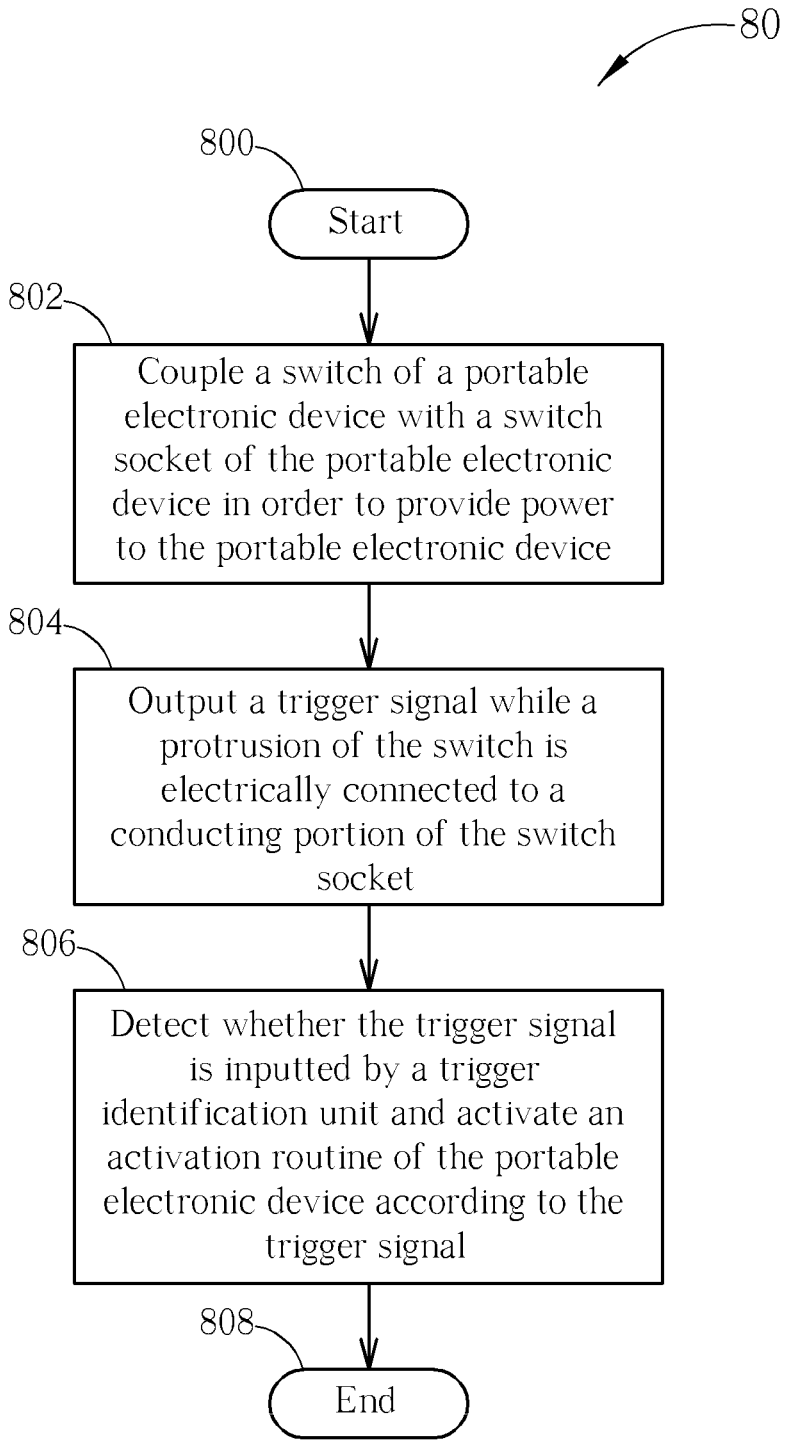
FIG. 8 is a schematic diagram of a procedure according to an embodiment of the present invention.

Furthermore, please refer to FIG. 8, which is a schematic diagram of a procedure 80 according to an embodiment of the present invention. The procedure 80 can be applied in the switch device 100 shown in FIG. 1A or the switch device 500 shown in FIG. 5, and comprises the following steps:

Step 800: Start.

Step 802: Couple a switch of a portable electronic device with a switch socket of the portable electronic device in order to provide power to the portable electronic device.

Step 804: Output a trigger signal while a protrusion of the switch is electrically connected to a conducting portion of the switch socket.

Step 806: Detect whether the trigger signal is inputted by a trigger identification unit and activate an activation routine of the portable electronic device according to the trigger signal.

Step 808: End.

According to the procedure 80, a portable electronic device can be activated after the switch is embedded in the switch socket, and a protrusion of the switch is taken a certain displacement to electrically couple with a conducting portion of the switch socket in order to output a trigger signal, such that the trigger identification unit will activate an activation routine of the portable electronic device according to the trigger signal. After that, the power-on key can be reduced to save cost, and more importantly, to save required space.

In summary, the present invention can implement a power-on process without a power-on key. As a result, the power-on key can be reduced to save cost, and more importantly, to save required space.

Those skilled in the art will readily observe that numerous modifications and alterations of the device and method may be made while retaining the teachings of the invention.

What is claimed is:

1. A switch device for implementing a power-on process for a portable electronic device, the switch device comprising:

a switch having a protrusion;

a switch socket installed in the portable electronic device comprising a slot and a conducting portion, wherein:

the slot is utilized for embedding the switch; and the conducting portion is utilized for outputting a trigger signal while the protrusion is electrically connected to the conducting portion; and a trigger identification unit installed in a keyboard controller unit, powered by a direct current power source and coupled to the conducting portion of the switch socket for activating an activation routine of the portable electronic device according to the trigger signal.

2. The switch device of claim 1, wherein an end of the switch is a power source.

3. The switch device of claim 1, wherein the slot comprises a first fixing unit for fixing the switch.

4. The switch device of claim 3, wherein the slot comprises a second fixing unit for fixing the switch, while the protrusion is electrically connected to the conducting portion.

5. A portable computer system, comprising:

a processing unit for executing functions of the portable computer system;

a keyboard controller unit installed in the processing unit for controlling operations of the processing unit; and a switch device comprising:

a switch having a protrusion for providing power; and a switch socket installed in the portable computer system comprising:

a slot for embedding the switch; and a conducting portion for outputting a trigger signal while the protrusion is electrically connected to the conducting portion; and a trigger identification unit installed in the keyboard controller unit, coupled between the conducting portion and the controller, and powered by a direct current power source for activating an activation routine of the portable computer system according to the trigger signal.

6. The portable computer system of claim 5, wherein an end of the switch is a power source.

7. The portable computer system of claim 5, wherein the slot comprises a first fixing unit for fixing the switch.

8. The portable computer system of claim 7, wherein the slot comprises a second fixing unit for fixing the switch while the protrusion is electrically connected to the conducting portion.

9. The portable computer system of claim 5, wherein the controller is a keyboard controller unit.

* * * * *